US006796338B2

(12) United States Patent
Baumann et al.

(10) Patent No.: US 6,796,338 B2
(45) Date of Patent: Sep. 28, 2004

(54) AIR JET WEAVING MACHINE AND COMPRESSED AIR SUPPLY FOR SAME

(75) Inventors: Heinz Baumann, Rüti (CH); Hans-Dieter Scorl, Rüti (CH); Herbert Burgbacher, Hilzingen (DE)

(73) Assignee: Sulzer Textil AG, Rueti (CH)

( * ) Notice: Subject to any disclaimer, the term of this patent is extended or adjusted under 35 U.S.C. 154(b) by 17 days.

(21) Appl. No.: 10/232,754

(22) Filed: Aug. 30, 2002

(65) Prior Publication Data

US 2003/0079792 A1 May 1, 2003

(30) Foreign Application Priority Data

Sep. 3, 2001 (EP) ..... 01810847

(51) Int. Cl.[7] ..... D03D 47/30
(52) U.S. Cl. ..... 139/435.2
(58) Field of Search ..... 139/435.1, 435.2, 139/435.3, 435.4, 435.5, 435.6

(56) References Cited

U.S. PATENT DOCUMENTS 4,595,039 A * 6/1986 Tholander ..... 139/435.2
4,716,941 A * 1/1988 Takegawa ..... 139/336
4,830,063 A * 5/1989 Takegawa ..... 139/435.2
5,440,495 A * 8/1995 Sainen et al. ..... 700/140

FOREIGN PATENT DOCUMENTS

| | | |
|---|---|---|
| DE | 195 17 748 A1 | 11/1995 |
| EP | 0 229 432 A2 | 7/1987 |
| EP | 0 344 104 A1 | 11/1989 |
| EP | 0 743 384 A2 | 11/1996 |

* cited by examiner

*Primary Examiner*—Danny Worrell
(74) *Attorney, Agent, or Firm*—Townsend and Townsend and Crew LLP

(57) ABSTRACT

The invention relates to an air jet weaving machine 1 with compressed air supply components for supplying air nozzles 3, 4, 5 and 6 with compressed air. The compressed air supply components comprise a compressed air infeed line with a main shut-off valve and an air filter as well as solenoid values and pressure regulators for controlling and regulating the compressed air which is supplied to the air nozzles, with some of the compressed air supply components being collected in a separate compressed air supply unit 10 which is arranged to be separate from the rest of the weaving machine.

10 Claims, 2 Drawing Sheets

AIR JET WEAVING MACHINE AND COMPRESSED AIR SUPPLY FOR SAME

BACKGROUND OF THE INVENTION

The invention relates to an air jet weaving machine with compressed air supply components for supplying air nozzles with compressed air. The compressed air supply components comprise a compressed air infeed line with a main shut-off valve and an air filter as well as solenoid valves and pressure regulators for controlling and regulating the compressed air which is supplied to the air nozzles.

Air jet weaving machines are equipped with a large number of air nozzles. A weft thread, which is wound up on a storage drum as a supply, is drawn off through at least one main nozzle, which is charged with compressed air, and is inserted into the open shed. Depending on the weaving conditions, such as the length of the weft thread to be inserted, the insertion frequency and the textile properties of the weft yarn, a plurality of main nozzles can be arranged one after the other in the insertion direction between the thread supply and the shed entrance as a group of so-called pre-nozzles and main nozzles. The pre-nozzles and main nozzles can be present doubly or multiply, depending on the number of weft threads to be inserted. An automatic control system ensures that the weft threads in the main nozzles are accelerated at the correct time with the ideal amount of air. The further transport of the weft threads through the shed is taken over by relay nozzles, which are actuated in groups in order to save on compressed air. The relay nozzles are fed from one or more compressed air reservoirs, which have different pressure levels in order to reduce the consumption of compressed air. At least one stretching nozzle provides for the stretching of the inserted weft thread until the beat up of the reed. In addition, blower and suction nozzles can be provided in order to remove and/or to hold in a definite position in the shed faulty weft threads and/or in order to dispose of the severed weft thread at the shed exit. For an economical operation the air pressure, the amount of air and the timing for all air nozzles must be matched to the yarns to be processed and to the weaving width. The yarns to be processed, for example simple or effect yarns in different finenesses of cotton, polyester, glass or the like, can have quite different properties.

An air jet weaving machine has a large number of compressed air supply components for supplying the various air nozzles with compressed air. The compressed air supply components comprise among other things a compressed air infeed line with a main shut-off valve and one or more air filters as well as solenoid valves and pressure regulators for controlling and regulating the compressed air which is supplied to the individual air nozzles. Furthermore, the compressed air supply components can comprise so-called time controllers, which are automatic pressure regulation systems for the control of the weft insertion. In the air jet weaving machines of the prior art the compressed air supply components are integrated into the weaving machine chassis. As a rule the main shut-off valve and the air filters as well as certain pressure regulators, for example the pressure regulators for the supply of the relay nozzles, are integrated into the chassis wall at the insertion side. Various other installations at the chassis wall however make access to these compressed air supply components more difficult. Maintenance work or settings, such as for example settings of a time controller for different weaving conditions, or system expansions, are thereby made more difficult.

SUMMARY OF THE INVENTION

It is an object of the invention to improve the accessibility of the compressed air supply components and to facilitate maintenance work, settings and system expansions at the components.

In the air jet weaving machine in accordance with the invention some of the compressed air supply components are collected in a separate compressed air supply unit which is arranged to be separate from the rest of the weaving machine. The separate compressed air supply unit comprises at least the compressed air infeed line with the main shut-off valve and air filter as well as some of the solenoid valves and pressure regulators, for example pressure regulators for supplying the main nozzles, the relay nozzles and/or the blowing and suction nozzles and/or a pressure regulator for the compressed air supply of the system, which serves among other things to supply the main nozzles with compressed air during the threading in. Solenoid valves can be provided in the separate compressed air supply unit for example for controlling the compressed air supply of the blowing and suction nozzles or of the main nozzles during the threading in.

The compressed air supply components in the separate compressed air supply unit preferably also comprise time controllers, which are automatic pressure regulation systems for the control of the weft insertion.

The separate compressed air supply unit is preferably designed as a module which is accessible from all sides, for example as a console, rack or battery frame. Covers, such as side walls and lids, are preferably removably designed. The separate compressed air supply unit is preferably designed with sufficient base freedom that inlet and outlet lines can take place from the base side of the compressed air supply unit. The inlet and outlet lines of the compressed air supply unit and the electrical connection lines of the compressed air supply unit are preferably designed flexibly so that the separate compressed air supply unit can be freely positioned within the line lengths which are available.

In a further preferred embodiment, compressed air supply components of a plurality of air jet weaving machines are collected in a single, separately arranged compressed air supply unit.

The air jet weaving machine in accordance with the invention, in which important compressed air supply components are collected in a separately arranged compressed air supply unit, has a substantially improved accessibility of the corresponding compressed air supply components. Maintenance and setting work on the compressed air supply components as well as system expansions and modifications are thereby greatly simplified and facilitated. In the design of the separately arranged compressed air supply unit, ergonomic considerations can better be taken into account, which was hardly possible in the previously usual integration of the compressed air supply components into the chassis wall at the insertion side and into other parts of the weaving machine chassis. The possibility of largely freely positioning the separate compressed air supply unit is a further great advantage, in that the position can be adapted to the local space conditions taking ergonomic considerations into account. Furthermore, the largely freely choosable positioning also allows an optimizing of the line lengths of the compressed air distribution lines and, associated therewith, an optimizing of the pressure drop in the compressed air distribution lines. In addition the weaving machine in accordance with the invention permits the arrangement of the individual compressed air supply components in the separate compressed air supply unit to be optimized according to function and manufacturing technology, which has advantages both with respect to reliability and with respect to the manufacturing costs. Additional economic advantages result when compressed air supply components of a plurality of air jet weaving machines are collected in a single, separately arranged compressed air supply unit.

A further advantage of the invention consists in that through the separate arrangement of the compressed air supply unit outside the rest of the weaving machine, detrimental influences on sensitive components of the compressed air supply, such as radiated heat in the drive region or machine oscillations, are completely eliminated.

The invention will be explained in the following in more detail with reference to the exemplary embodiment and with reference to the drawings.

DESCRIPTION OF THE PREFERRED EMBODIMENTS

Figure 1:
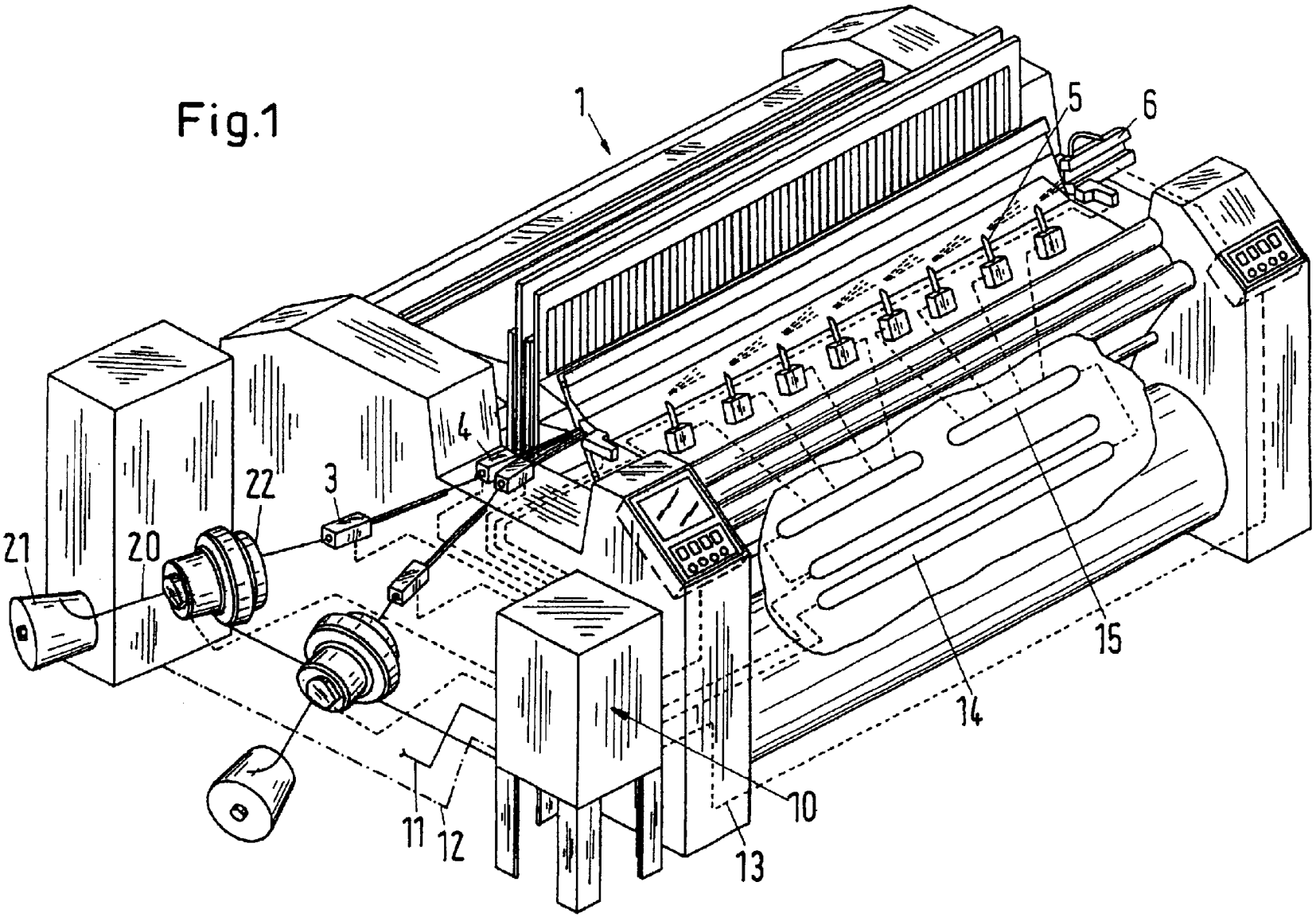
FIG. 1 is a schematic perspective view of an air jet weaving machine in accordance with an exemplary embodiment of the present invention.

FIG. 1 shows an exemplary embodiment of an air jet weaving machine 1 in accordance with the present invention. A weft thread 20 enters from a yarn bobbin 21 into a thread store 22, from which it is transported by means of compressed air to a pre-nozzle 3 and then to a main nozzle 4. The actual weft insertion takes place by means of the pre-nozzle 3 and the main nozzle 4, which are charged with compressed air, with an automatic control system, which is known under the name of 'time controller', ensuring that the weft thread 20 is accelerated with the ideal amount of air at the right point in time. The designation 'time controller' results from the fact that the acceleration of the weft thread 20 is controlled in dependence on the effectively measured flight time of the weft thread 20. Of course a large number of pre-nozzles 3 and a large number of main nozzles 4 can be provided in order alternately to insert different weft threads 20, which can differ in color, fineness, texture and material. The further transport of the weft threads 20 through the shed is taken over by relay nozzles 5, which are actuated in groups in order to save on compressed air. The relay nozzles 5 are fed via compressed air distributors 15 from one or more compressed air reservoirs 14 which can have different pressure levels in order to reduce the consumption of compressed air. A stretching nozzle 6 ensures that the introduced weft thread 20 remains stretched until the reed beat up. In addition, blower and/or suction nozzles can be provided in order to remove faulty weft threads 20. For an economical operation, the air pressure, the amount of air and the timing for all air nozzles 3, 4, 5 and 6 must be adapted to the yarn to be processed and to the weaving width.

Further drawn in in FIG. 1*a* are a separately arranged compressed air supply unit 10, a compressed air infeed line 11 for connection of the separately arranged compressed air supply unit 10 to a compressed air distributor network, an electrical control line 12 and compressed air distributor lines 13. The air nozzles 3, 4, 5 and 6 of the separately arranged compressed air supply unit 10 are supplied with compressed air via the compressed air distributor lines 13, which are drawn in in broken lines in FIG. 1, as well as via possible further (not illustrated) compressed air supply components, such as for example solenoid valves.

The separate compressed air supply unit of the exemplary embodiment is designed as a module which is accessible from all sides, for example as a console, rack or battery frame. Side walls, lids and other possible covers are designed to be removable. The covers are provided with cut-outs for operating elements such as for example setting and regulation knobs or manual valves. The separate compressed air supply unit of the exemplary embodiment is equipped with legs, which results in an ideal working height for maintenance work and settings and creates sufficient base freedom for the inlet and outlet lines to take place from the base side. The inlet and outlet lines for the compressed air and the electrical control lines are designed to be flexible, so that the separate compressed air supply unit can be freely positioned within the line lengths which are available.

Figure 2:
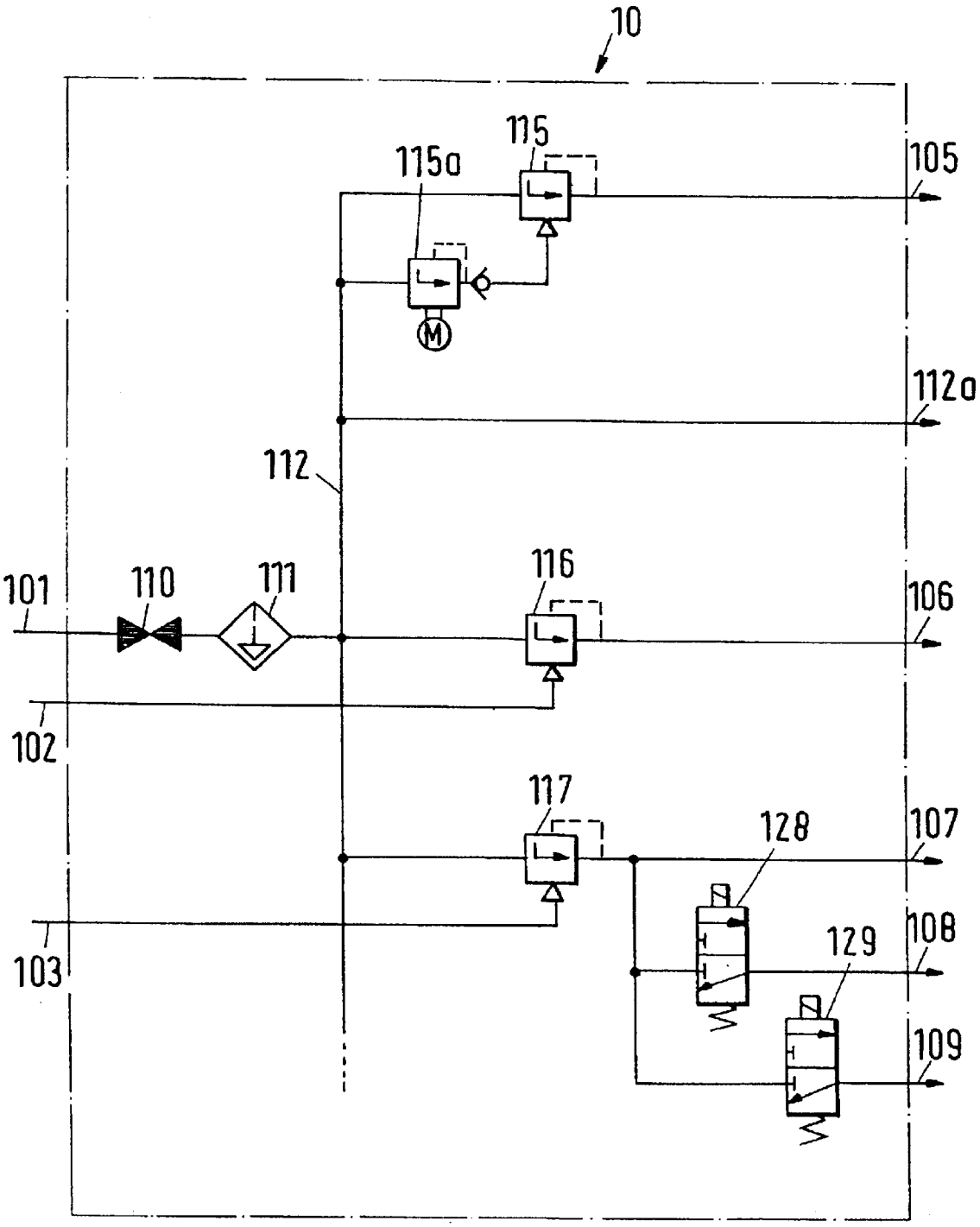
FIG. 2 is a block diagram of the compressed air supply components which are collected in a separate compressed air supply unit in accordance with the exemplary embodiment.

FIG. 2 shows a block diagram of the compressed air supply components which are collected in the separate compressed air supply unit 10 in accordance with the invention. The compressed air from the compressed air distribution network arrives at an internal compressed air distributor line 112 via a compressed air infeed line 101, a main shut-off valve 110 and one or more air filters 111 with water separators. Connected up to the internal compressed air distributor line 112 are among other things three pressure reduction valves 115, 116 and 117, an external compressed air distributor line 112*a* and possible further, not illustrated compressed air supply components. The external compressed air distributor line 122*a* serves for connecting up external compressed air supply components. In the exemplary embodiment the pressure reduction valves 115, 116 and 117 are pneumatically controlled. In place of the pneumatically controlled pressure reduction valves, manually or motor controlled pressure reduction valves can, however, also be used. The pressure reduction valve 115 supplies one or more main valves with compressed air via a compressed air distributor line 105. A motor controlled pressure reduction valve 155*a* is connected up to the compressed air distributor line 112 at the input side and is connected to the control input of the pneumatically controlled pressure reduction valve 115 at the output side. The pressure reduction valves 115 and 155*a* are part of an automatic control system, which controls the weft insertion in the main nozzle, which is fed by the compressed air distributor line 105. The electronic and technical measuring components of this automatic control system, which is also designated as a 'time controller', are not drawn in in FIG. 2. The pressure reduction valves 115 and 115*a* can also be multiply present in order to supply a plurality of nozzle groups, consisting of pre-nozzles and main nozzles, with compressed air. The pressure reduction valve 116 supplies the relay nozzles with compressed air via a compressed air distributor line 106 and via external compressed air reservoirs and distributors and via externally arranged solenoid valves. A compressed air line 102 is connected to the control input of the pneumatically controlled pressure reduction valve 116 and serves to apply a corresponding control pressure, which can for example be set by means of a manual pressure reduction valve, which is e.g. arranged in an operating area. The pressure reduction valve 117 serves for the setting and regulation of the pressure in the compressed air supply of the system. A compressed air line 103 is connected to the control input of the pneumatically controlled pressure reduction valve 117 and serves to apply a corresponding control pressure. In the exemplary embodiment the compressed air supply of the system in the separate compressed air supply unit 10 comprises two solenoid valves 128 and 129 as well as a connector for an external compressed air distribution line 107 for connecting up external compressed air supply components. The solenoid valve 128 is connected at the output side via a compressed air distributor line 108 to a blower nozzle and a suction nozzle, which serve for the removal of faulty weft threads. The solenoid valve 129 is connected at the output side via a compressed air distributor line 109 to a main nozzle. The compressed air which is supplied via the solenoid valve 129 serves in the exemplary embodiment for the threading in of the weft thread into the corresponding main nozzle.

The above description of the compressed air supply components which are collected in the separate compressed air supply unit 10 in accordance with the exemplary embodiment is by no means exhaustive, but serves merely as an example.

In a further exemplary embodiment, compressed air supply components of a plurality of air jet weaving machines are collected in a single, separately arranged compressed air supply unit 10. Thus, for example, a single compressed air supply unit which is set up between two air jet weaving machines can supply both air jet weaving machines with compressed air. An arrangement of this kind has economical and space-related advantages.

What is claimed is:

1. Air jet weaving machine comprising compressed air supply components for supplying air nozzles with compressed air, said compressed air supply components comprising a compressed air infeed line with a main shut-off valve and an air filter as well as solenoid valves and pressure regulators for controlling and regulating the compressed air which is supplied to the air nozzles, a number of the compressed air supply components being part of a separate compressed air supply unit which is arranged separately from the rest of the weaving machine and which comprises at least the compressed air infeed line with the main shut-off valve and the air filter as well as some of the solenoid valves and pressure regulators.

2. Air jet weaving machine in accordance with claim 1, wherein the compressed air supply unit is executed as a unit which is accessible from all sides.

3. Air jet weaving machine in accordance with claim 1, wherein the side walls and covers of the compressed air supply unit are removable.

4. Air jet weaving machine in accordance with claim 1, wherein at least a portion of the inlet and outlet lines of the compressed air supply unit are arranged at a base side of the compressed air supply unit.

5. Air jet weaving machine in accordance with claim 1, wherein the inlet and outlet lines of the compressed air supply unit for the compressed air and the electrical connection lines of the compressed air supply unit are flexible.

6. Air jet weaving machine in accordance with claim 1, wherein the compressed air supply unit additionally comprises at least one pressure regulation system for the control of the weft insertion.

7. Compressed air supply unit for supplying one or more air jet weaving machines with compressed air, the compressed air supply unit being arranged separately and separately from the weaving machine and comprising at least one compressed air infeed line with at least one main shut-off valve for each air jet weaving machine supplied and with a plurality of air filters as well as solenoid valves and pressure regulators for controlling and regulating the compressed air which is supplied to the weaving machines by the compressed air supply unit.

8. Compressed air supply unit in accordance with claim 7, wherein the compressed air supply unit is configured to be accessible from all sides.

9. Compressed air supply unit in accordance with claim 7, wherein the side walls and covers of the compressed air supply unit are removable.

10. Compressed air supply unit in accordance with claim 1, wherein the inlet and outlet lines of the compressed air supply unit for the compressed air and the electrical connection lines of the compressed air supply unit are flexible.

* * * * *